US008253661B2

(12) United States Patent
Sun et al.

(10) Patent No.: US 8,253,661 B2
(45) Date of Patent: Aug. 28, 2012

(54) METHOD OF COMPENSATING FOR LUMINANCE OF AN ORGANIC LIGHT EMITTING DIODE DISPLAY

(75) Inventors: Wein-Town Sun, Taoyuan County (TW); Jung-Chun Tseng, Pingtung County (TW)

(73) Assignee: Au Optronics Corp., Hsin-Chu (TW)

( * ) Notice: Subject to any disclaimer, the term of this patent is extended or adjusted under 35 U.S.C. 154(b) by 652 days.

(21) Appl. No.: 12/366,427

(22) Filed: Feb. 5, 2009

(65) Prior Publication Data

US 2009/0141051 A1 Jun. 4, 2009

Related U.S. Application Data

(63) Continuation of application No. 11/154,678, filed on Jun. 17, 2005, now Pat. No. 7,554,513.

(30) Foreign Application Priority Data

Jun. 17, 2004 (TW) ..... 93117565 A

(51) Int. Cl.
*G09G 3/30* (2006.01)
*G09G 3/32* (2006.01)

(52) U.S. Cl. ..... 345/77; 345/82

(58) Field of Classification Search ..... 345/77, 345/82

See application file for complete search history.

(56) References Cited

U.S. PATENT DOCUMENTS

| | | | | |
|---|---|---|---|---|
| 5,903,246 | A | 5/1999 | Dingwall | |
| 6,320,325 | B1 | 11/2001 | Cok et al. | |
| 6,496,168 | B1 | 12/2002 | Tomida | |
| 6,501,230 | B1 | 12/2002 | Feldman | |
| 6,518,962 | B2 | 2/2003 | Kimura et al. | |
| 6,747,417 | B2 | 6/2004 | Meade et al. | |
| 6,806,853 | B2 | 10/2004 | Park et al. | |
| 7,068,292 | B2 | 6/2006 | Morita et al. | |
| 7,091,937 | B2 * | 8/2006 | Nakamura | 345/77 |
| 7,215,307 | B2 | 5/2007 | Ochi et al. | |
| 7,221,338 | B2 | 5/2007 | Yamazaki et al. | |
| 7,274,363 | B2 * | 9/2007 | Ishizuka et al. | 345/211 |
| 7,304,621 | B2 | 12/2007 | Oomori et al. | |
| 7,321,348 | B2 | 1/2008 | Cok et al. | |
| 2001/0013758 | A1 | 8/2001 | Tsuruoka et al. | |
| 2002/0101172 | A1 * | 8/2002 | Bu | 315/169.3 |
| 2003/0151578 | A1 | 8/2003 | Morita | |
| 2004/0070558 | A1 | 4/2004 | Cok et al. | |
| 2004/0222954 | A1 * | 11/2004 | Lueder | 345/87 |
| 2004/0239595 | A1 | 12/2004 | Vulto et al. | |
| 2004/0239661 | A1 * | 12/2004 | Jo | 345/204 |

* cited by examiner

*Primary Examiner* — Adam J Snyder
(74) *Attorney, Agent, or Firm* — Rabin & Berdo, P.C.

(57) ABSTRACT

A method of compensating for luminance of an organic light emitting diode is provided. In an embodiment, an operational current of a dummy organic light emitting diode of a color is utilized to simulate the condition that a real pixel current attenuates with time, and a feedback current is outputted accordingly. A compensating voltage is generated according to the feedback current, and is used to regulates the data current inputted to the real pixel so as to compensate for the luminance of the real pixel of the color.

15 Claims, 6 Drawing Sheets

METHOD OF COMPENSATING FOR LUMINANCE OF AN ORGANIC LIGHT EMITTING DIODE DISPLAY

This is a continuation of co-pending U.S. patent application Ser. No. 11/154,678, filed Jun. 17, 2005, and for which priority is claimed under 35 U.S.C. §120; and this application, under U.S.C. §119, claims the benefit of Taiwan application Serial No. 93117565, filed Jun. 17, 2004, the subject matter of which is incorporated herein by reference.

BACKGROUND OF THE INVENTION

1. Field of the Invention

The invention relates in general to an organic light emitting diode (OLED) display and luminance compensating method thereof, and more particularly to an OLED display, which utilizes the operational current of a dummy OLED to simulate the change of the real pixel current, and luminance compensating method thereof.

2. Description of the Related Art

FIG. 1 is a block diagram showing a circuit structure of a conventional OLED display. The OLED display 100 includes a data driver 110, a pixel matrix 120 and a scan driver 130. The pixel matrix 120 includes several red pixels (R_Pixels) 122, several green pixels (G_Pixels) 124 and several blue pixels (B_Pixels) 126, each of which includes an OLED (not shown in the figure). The data driver 110 includes a horizontal shift register 112, a plurality of red digital/analog current converters R_DACs 114, a plurality of green digital/analog current converters G_DACs 116, and a plurality of blue digital/analog current converters B_DACs 118.

The R_DAC 114, G_DAC 116 and B_DAC 118 respectively receive the digital data R_Data, G_Data and B_Data from the horizontal shift register 112 and convert them into analog currents $I_R$, $I_G$ and $I_B$ according to a reference voltage Vbias. These analog currents $I_R$, $I_G$ and $I_B$ are respectively sampled and held by a red sample/hold unit (R_S/H) 115, a green sample/hold unit G_S/H 117 and a blue sample/hold unit B_S/H 119, and then data currents $I_{DR}$, $I_{DG}$ and $I_{DB}$ are thus generated and outputted to the R_Pixel 122, G_Pixel 124 and B_Pixel 126. The scan driver 130 turns on control switches (not shown in the figure) contained in each row of the pixels 122, 124 and 126 in the pixel matrix 120 in a row-by-row manner such that the OLEDs in each row of the pixels 122, 124 and 126 emit light.

Because the luminance efficiency of the OLED attenuates with the usage time and the luminance attenuation degrees of the red, green and blue pixels are different, the OLED display usually cannot display the correct picture frames after a period of time.

SUMMARY OF THE INVENTION

It is therefore an object of the invention to provide a display luminance compensating device and a method thereof, wherein an operational current of a dummy OLED in a feedback circuit is utilized to simulate the condition that the real pixel current attenuates with time, and then a feedback current is outputted accordingly. A compensating circuit generates a compensating voltage according to the feedback current, and regulates the data current inputted to the real pixel to compensate for the luminance of the real pixel such that the display can display the correct color frame.

The invention achieves the above-identified object by providing an organic light emitting diode display including a first digital/analog current converter, a second digital/analog current converter, a feedback unit and a compensating unit. The feedback unit includes a first feedback circuit for providing a first feedback current and a second feedback circuit for providing a second feedback current.

The compensating unit, electrically coupled to the feedback unit, includes a first compensating circuit and a second compensating circuit for outputting a first compensating voltage and a second compensating voltage as a first reference voltage and a second reference voltage for the first and second digital/analog current converters in accordance with the first and second feedback currents respectively.

Each of the first feedback circuit and the second feedback circuit includes a feedback current mirror circuit and a dummy OLED. The feedback current mirror circuit comprises a first PMOS transistor and a second PMOS transistor. The gate and the drain of the first PMOS transistor are electrically connected to each other. The drain of the first PMOS transistor is coupled to the dummy OLED. The drain of the second PMOS transistor is for outputting the first/second feedback current.

Each of the first and second feedback circuits includes a feedback current mirror circuit and a plurality of dummy OLEDs connected to each other in parallel. The feedback current mirror circuit includes a first PMOS transistor and a second PMOS transistor. The gate and the drain of the first PMOS transistor are electrically connected to each other. The drain of the first PMOS transistor is coupled to the dummy OLEDs. The drain of the second PMOS transistor is for outputting the first/second feedback current.

Each of the first and second compensating circuits includes a compensating current mirror circuit including a resistor, a first NMOS transistor and a second NMOS transistor. The gate and the drain of the first NMOS transistor are electrically connected to each other. The drain of the second NMOS transistor is connected to an operational voltage through the resistor. The drain of the second NMOS transistor is for outputting the first/second compensating voltage.

The first digital/analog current converter and a second digital/analog current converter provide a first data current and a second data current to a first pixel and a second pixel. As soon as the luminance of the first and second pixels attenuates with time, the first and second feedback currents reduce with time, such that the first and second compensating voltages increase accordingly. The first and second compensating voltages respectively increase the first and second reference voltages so as to increase the first and second data currents.

The invention also achieves the above-identified object by providing a method of compensating for the luminance of a display having a first pixel and a second pixel. The method includes the steps of generating a first feedback current and a second feedback current, wherein the first feedback current and the second feedback current change is positively proportional to the luminance change of the first and second pixels; generating a first compensating voltage and a second compensating voltage in accordance with the first and second feedback currents; and adjusting the first and the second data currents in accordance with the first and the second compensating voltages, respectively, wherein the changes of the first and the second data currents are inversely proportional to the changes of the first and the second compensating voltages.

The step of generating the first and the second feedback currents includes the sub-steps of: providing a first operational current for a first dummy light emitting component and a second operational current for a second dummy light emitting component; and duplicating the first and second operational currents as the first and second feedback currents. This method utilizes a first current mirror circuit and a second current mirror circuit to provide the first and the second operational currents and to duplicate the first and second feedback currents.

Other objects, features, and advantages of the invention will become apparent from the following detailed description of the preferred but non-limiting embodiments. The following description is made with reference to the accompanying drawings.

DETAILED DESCRIPTION OF THE INVENTION

The main feature of the display luminance compensating device of the invention is to utilize an operational current of a dummy OLED in a feedback circuit to simulate the condition that the real pixel current attenuates with time, and then a feedback current is outputted accordingly. A compensating circuit generates a compensating voltage according to the feedback current as a reference voltage for a digital/analog current converter, regulates the data current inputted to the real pixel, and compensates for the luminance of the real pixel such that the display can display the correct color picture frames.

Figure 1:
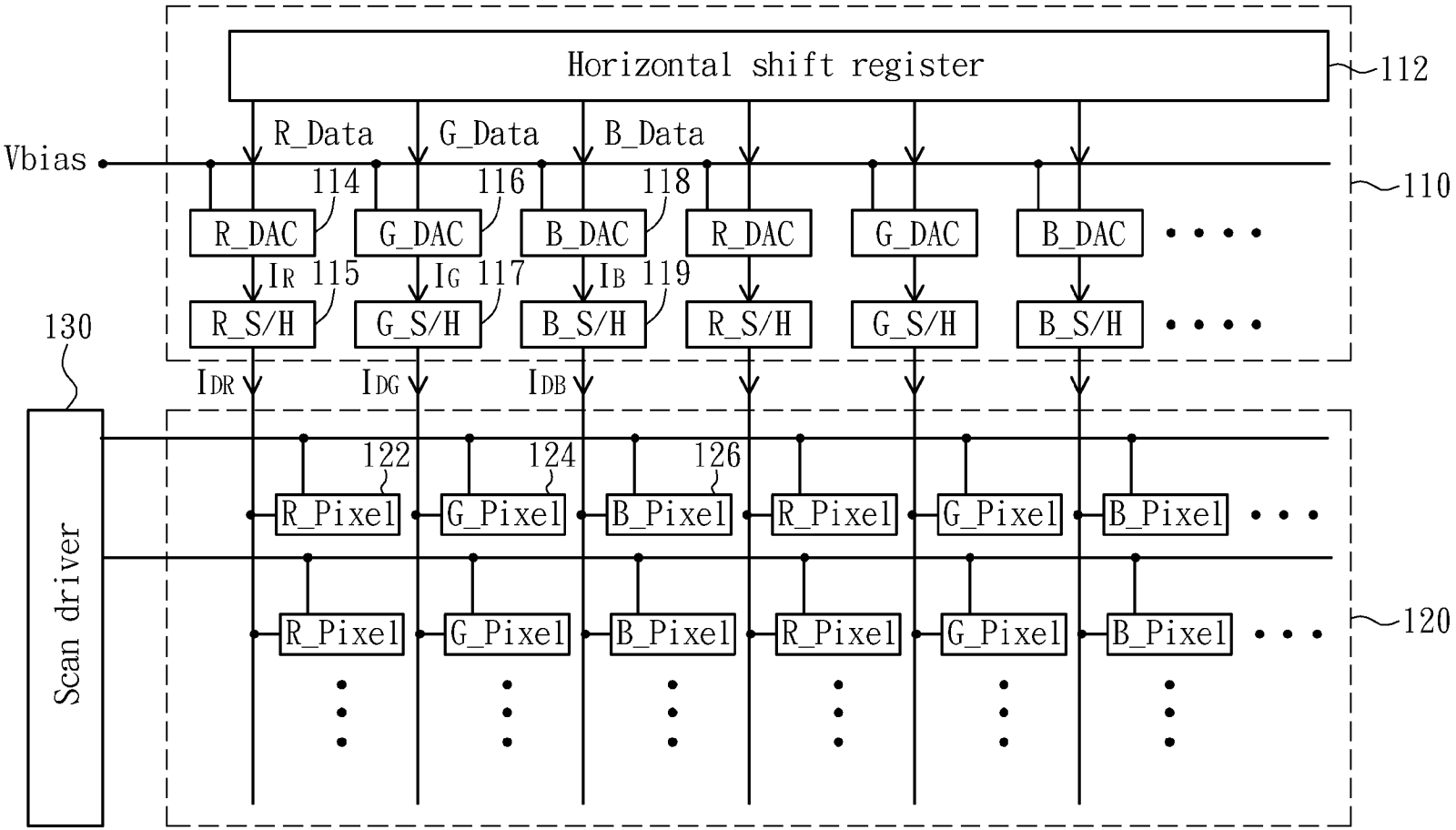
FIG. 1(PRIOR ART)
FIG. 1 is a block diagram showing a circuit structure of a conventional OLED display.
Figure 2A:
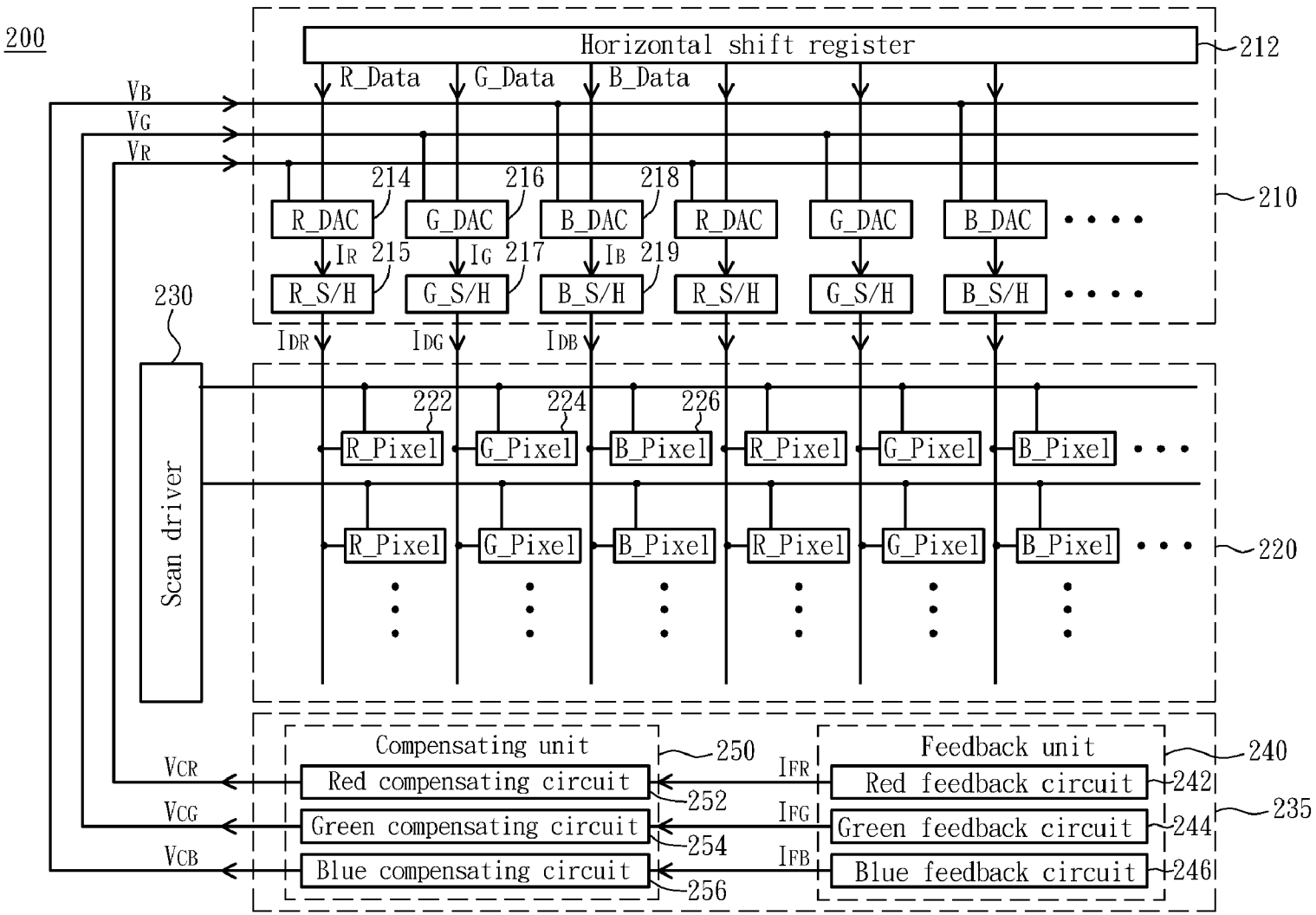
FIG. 2A is a block diagram showing a circuit structure of a display according to a preferred embodiment of the invention.

FIG. 2A is a block diagram showing a circuit structure of a display according to a preferred embodiment of the invention. Referring to FIG. 2A, the display 200 includes a data driver 210, a pixel matrix 220, a scan driver 230 and a luminance compensating device 235. The data driver 210 includes a horizontal shift register 212, R_DACs 214, G_DACs 216, B_DACs 218, R_S/Hs 215, G_S/Hs 217, and B_S/Hs 219. The pixel matrix 220 is located in the active region (not shown in the figure) and includes R_Pixels 222, G_Pixels 224 and B_Pixels 226.

Figure 2B:
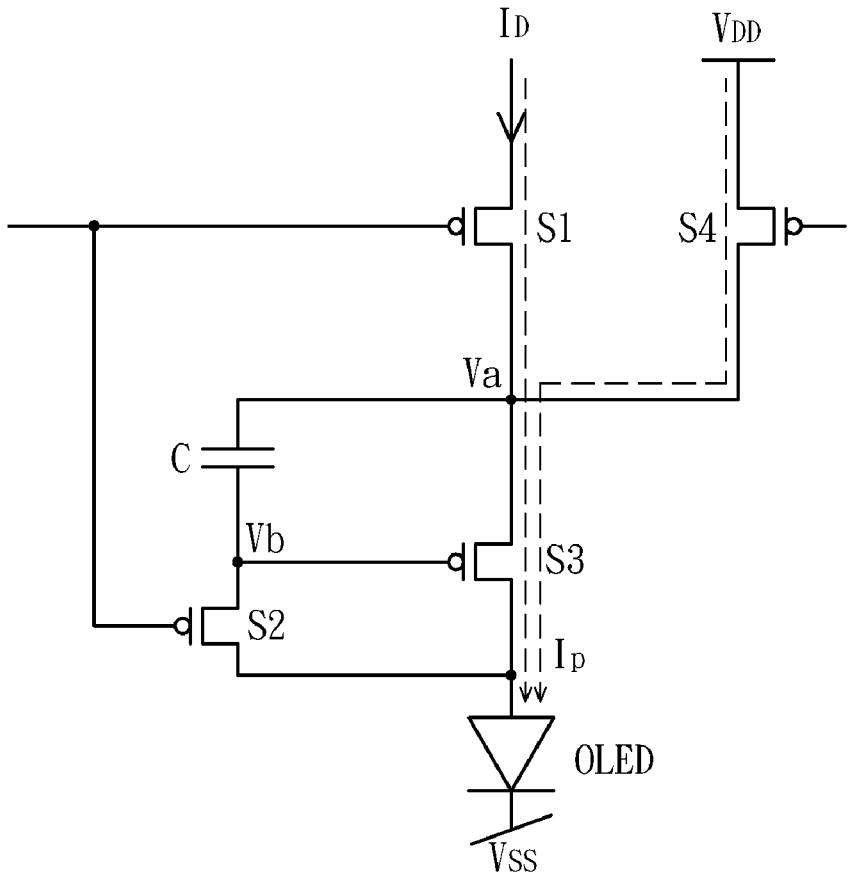
FIG. 2B shows a circuit structure of a pixel of FIG. 2A.

The R_DAC 214, G_DAC 216 and B_DAC 218 respectively receive digital data R_Data, G_Data and B_Data from the horizontal shift register 212 and convert them into analog currents $I_R$, $I_G$ and $I_B$ according to reference voltages $V_R$, $V_G$ and $V_B$. These analog currents $I_R$, $I_G$ and $I_B$ are respectively sampled and held by the R_S/H 215, G_S/H 217 and B_S/H 219, and then data currents $I_{DR}$, $I_{DG}$ and $I_{DB}$ are generated and outputted to the R_Pixel 222, G_Pixel 224 and B_Pixel 226. The scan driver 230 simultaneously turns on control switches S1, S2, and S3 contained in each row of the R_Pixel 222, G_Pixel 224 or B_Pixel 226 in the pixel matrix 220 in a row-by-row manner, as shown in FIG. 2B, such that the data current $I_D$(=$I_{DR}$, $I_{DG}$ or $I_{DB}$) can flow into the OLED as an operational current $I_P$ for enabling the OLED to emit light. At the same time, the capacitor C is charged by a voltage drop (Va-Vb). In the next scanning period, the switches S1 and S2 are turned off and the switches S3 and S4 are turned on such that a current generated by the voltage Vdd can subsequently serve as the operational current $I_P$ for enabling the OLED to emit light. Because the voltage drop (Va-Vb) is kept by the capacitor C, the operational current $I_P$ is substantially the same as the data current $I_D$.

Figure 2C:
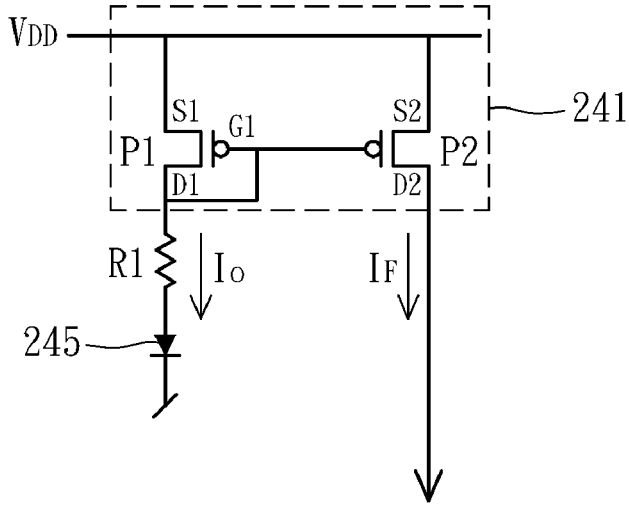
FIG. 2C shows a circuit structure of a feedback circuit of FIG. 2A.

The luminance compensating device 235 includes a feedback unit 240 and a compensating unit 250. The feedback unit 240 includes a red feedback circuit 242, a green feedback circuit 244 and a blue feedback circuit 246 for outputting feedback currents $I_{FR}$, $I_{FG}$ and $I_{FB}$, respectively. As shown in FIG. 2C, each of the feedback circuits 242, 244 and 246 includes a feedback current mirror circuit 241 and a dummy OLED 245. The feedback current mirror circuit 241 includes a PMOS (P-typed Metal Oxide Semiconductor) transistor P1 and a PMOS transistor P2. The gate G1 and the drain D1 of the transistor P1 are electrically connected to each other. The dummy OLED 245 is electrically connected to the drain D1 of the transistor P1 through a resistor R1. In addition, the sources S1 and S2 of the transistors P1 and P2 are connected to the operational voltage VDD. When the drain D1 of the transistor P1 outputs the operational current $I_O$(=$I_{OR}$, $I_{OG}$ or $I_{OB}$), the drain D2 of the transistor P2 outputs the feedback current $I_F$(=$I_{FR}$, $I_{FG}$ or $I_{FB}$), wherein the feedback current $I_F$ is substantially equal to the operational current $I_O$. The invention utilizes the operational current $I_O$ flowing through the dummy OLED 245 to simulate the condition that the real pixel current $I_P$ attenuates with time.

Figure 2D:
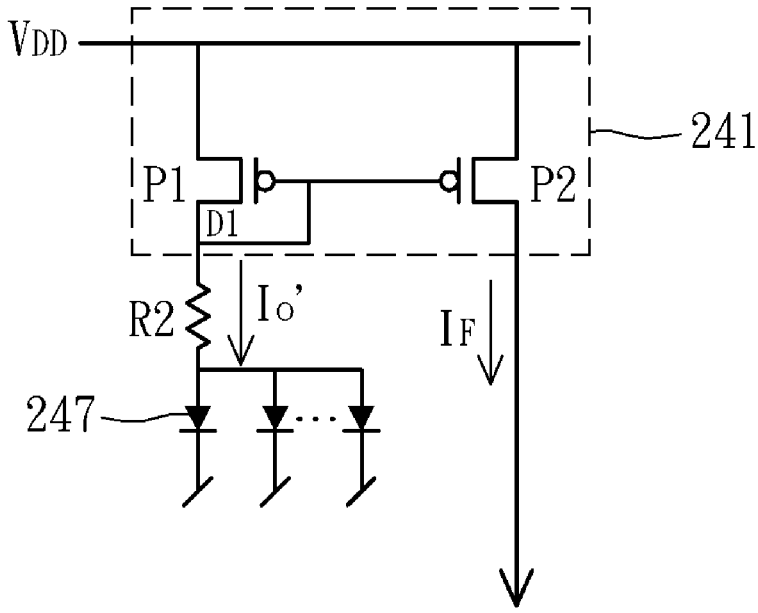
FIG. 2D shows another circuit structure of the feedback circuit of FIG. 2A.

Of course, each of the feedback circuits 242, 244 and 246 may include a feedback current mirror circuit 241 and a plurality of OLEDs 247 emitting light of the same color and connected to each other in parallel, as shown in FIG. 2D. These OLEDs 247, connected to each other in parallel, are connected to the drain D1 of the transistor P1 through a resistor R2. The operational current $I_{O'}$ ($I_{OR'}$, $I_{OG'}$ or $I_{OB'}$) generated by using the same color OLEDs connected to each other in parallel is the sum of the currents flowing through the OLEDs 247. Because the current attenuation degrees of the OLEDs 247 of the same color in the real pixel matrix 220 are different, the operational current $I_{O'}$ can simulate an average current attenuation degree of several OLEDs 247 of the same color in the better manner.

Figure 2E:
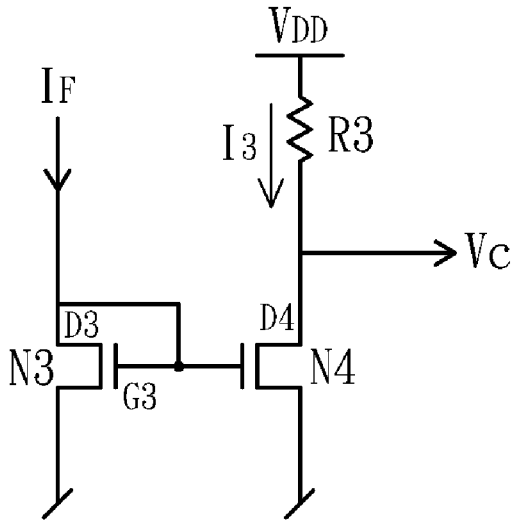
FIG. 2E shows a circuit structure of a compensating circuit of FIG. 2A.

The compensating unit 250 includes a red compensating circuit 252, a green compensating circuit 254 and a blue compensating circuit 256 for respectively outputting compensating voltages $V_{CR}$, $V_{CG}$ and $V_{CB}$ as reference voltages $V_R$, $V_G$ and $V_B$ for R_DAC 214, G_DAC 216 and B_DAC 218 according to the feedback currents $I_{FR}$, $I_{FG}$ and $I_{FB}$. As shown in FIG. 2E, each of the compensating circuits 252, 254 and 256 is a compensating current mirror circuit, which includes a NMOS transistor N3 and a NMOS transistor N4. The gate G3 and drain D3 of the transistor N3 are electrically connected to each other. The feedback current $I_F$ is inputted to the drain D3 of the transistor N3. The drain D4 of the transistor N4 outputs a compensating voltage $V_C$ (=$V_{CR}$, $V_{CG}$ or $V_{CB}$), and the drain D4 of the transistor N4 is connected to the operational voltage $V_{DD}$ through a resistor R3. According to the current mirror principle, the current I3 flowing through the resistor R3 is equal to the feedback current $I_F$. Therefore, the compensating voltage $V_C$ is equal to ($V_{DD}$−$I_F$×R3).

When the luminance of R_Pixel 222, G_Pixel 224 and B_Pixel 226 attenuates with time, the luminance of the OLED 245 in the feedback circuits 242, 244 and 246 also attenuates with time. That is, the operational currents $I_{OR}$, $I_{OG}$ and $I_{OB}$ attenuate with time such that the duplicated feedback currents $I_{FR}$, $I_{FG}$ and $I_{FB}$ also attenuate with time. According to the above-mentioned equation: the compensating voltage $V_C=V_{DD}-I_F\times R3$, the decreases of the feedback currents $I_{FR}$, $I_{FG}$ and $I_{FB}$ increase the compensating voltages $V_{CR}$, $V_{CG}$ and $V_{CB}$, and thus increase the reference voltages $V_R$, $V_G$ and $V_B$. Because the reference voltages $V_R$, $V_G$ and $V_B$ are increased, the analog currents $I_R$, $I_G$ and $I_B$ are also increased. Hence, the data currents $I_{DR}$, $I_{DG}$ and $I_{DB}$ are also increased to compensate for the luminance of the R_Pixel 222, G_Pixel 224 and B_Pixel 226.

Figure 3A:
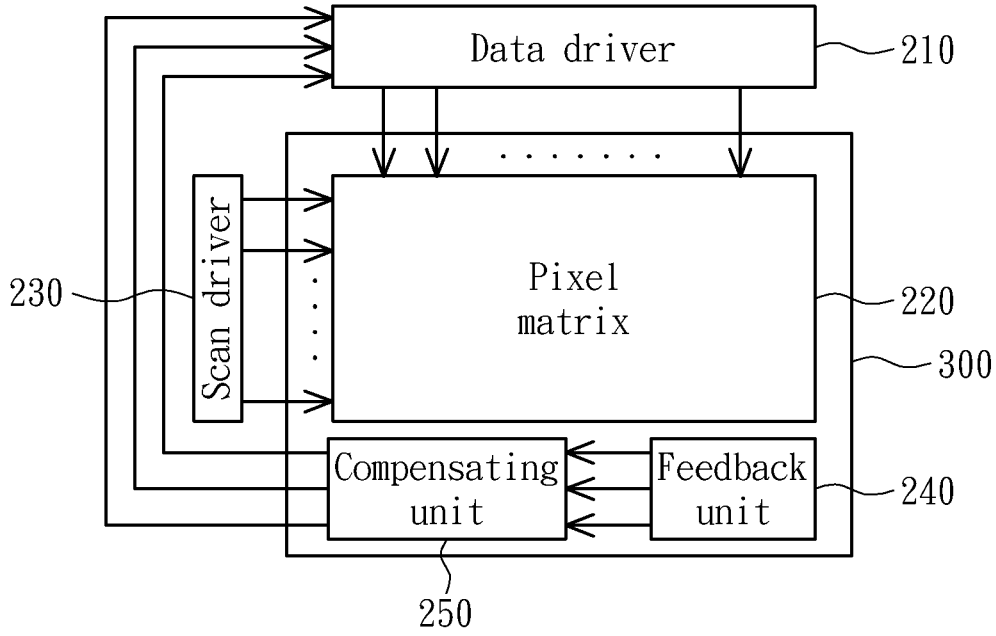
FIG. 3A is a schematic illustration showing a relative position between the feedback circuit and the compensating circuit of FIG. 2A, which are disposed on the display.
Figure 3B:
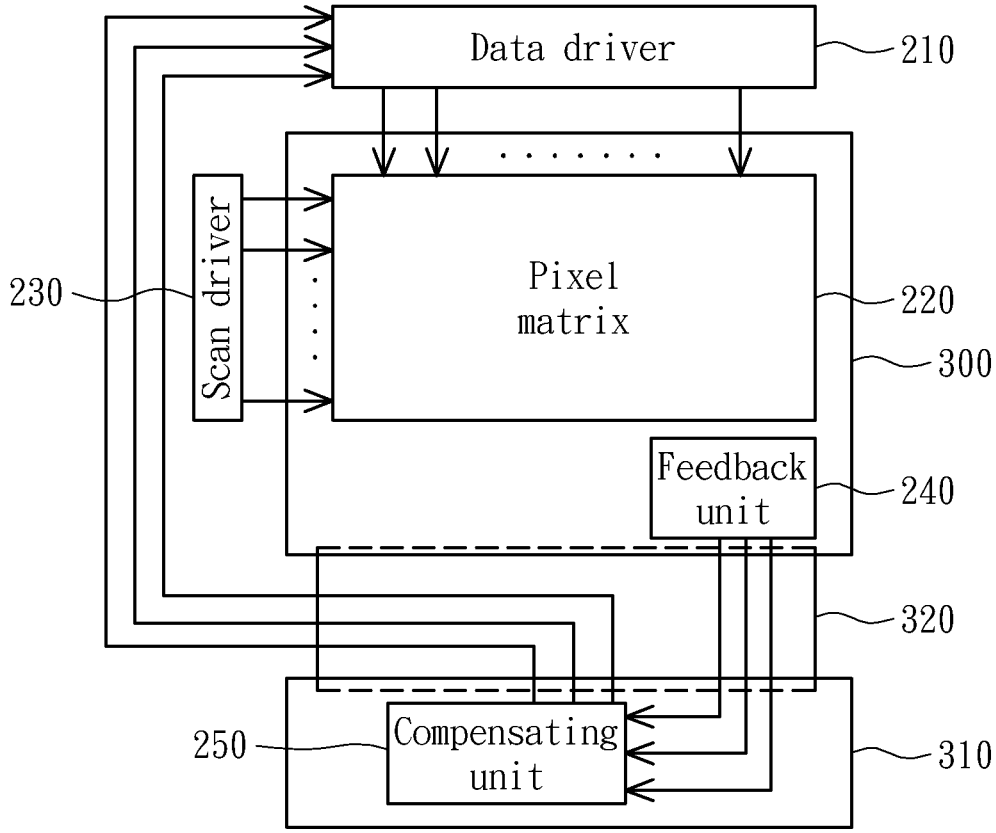
FIG. 3B is a schematic illustration showing another relative position between the feedback circuit and the compensating circuit of FIG. 2A, which are disposed on the display.

The feedback unit 240 and the compensating unit 250 are disposed on a display panel 300 of the display 200, as shown in FIG. 3A. Alternatively, the feedback unit 240 is disposed on the display panel 300 while the compensating unit 250 is disposed on a printed circuit board 310 of the display 200, and the printed circuit board 310 is connected to the display panel 300 through a flexible circuit board 320, as shown in FIG. 3B.

Figure 4:
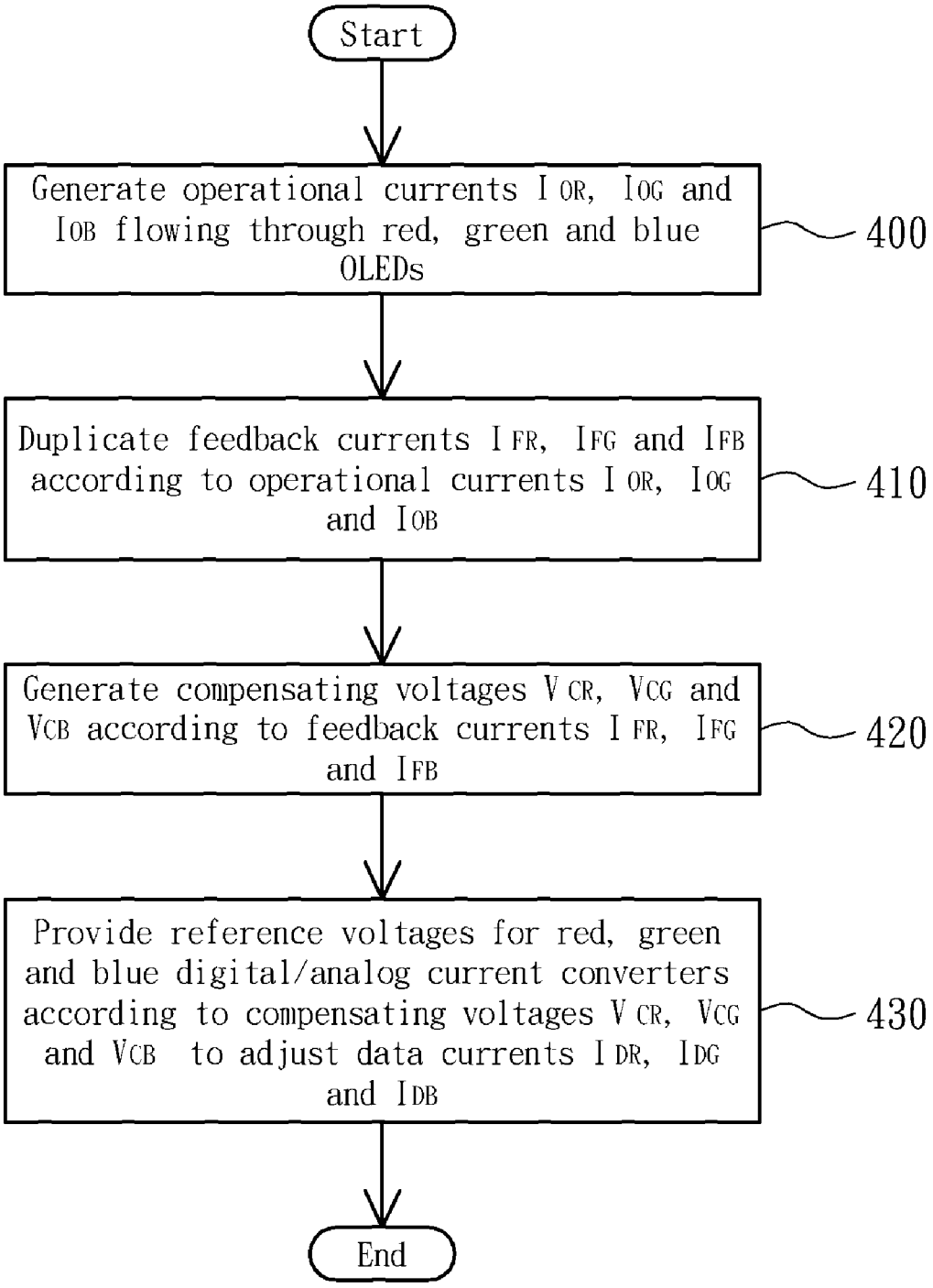
FIG. 4 is a flow chart showing a method of compensating for the luminance of the display according to the preferred embodiment of the invention.

FIG. 4 is a flow chart showing a method of compensating for the luminance of the display according to the preferred embodiment of the invention. First, in the step 400, the feedback circuits 242, 244 and 246 generate the operational currents $I_{OR}$, $I_{OG}$ and $I_{OB}$ flowing through the red, green and blue OLEDs 245. Next, in the step 410, the feedback currents $I_{FR}$, $I_{FG}$ and $I_{FB}$ are duplicated using the feedback current mirror circuit 241 according to the operational currents $I_{OR}$, $I_{OG}$ and $I_{OB}$. Obviously, when the pixel luminance of the R_Pixel 222, G_Pixel 224 and B_Pixel 226 attenuates with time, the operational currents $I_{OR}$, $I_{OG}$ and $I_{OB}$ of the OLED 245 in the feedback circuits 242, 244 and 246 also attenuate with time. The duplicated feedback currents $I_{FR}$, $I_{FG}$ and $I_{FB}$ also attenuate with time. Hence, the operational currents $I_{OR}$, $I_{OG}$ and $I_{OB}$ can be used to simulate the condition that the pixel currents $I_P$ in the real pixels 222, 224 and 226 attenuates with time. In the step 420, the compensating voltages $V_{CR}$, $V_{CG}$ and $V_{CB}$ are generated using the compensating circuits 252, 254 and 256 according to the feedback currents $I_{FR}$, $I_{FG}$ and $I_{FB}$. The compensating circuits 252, 254 and 256 are the above-mentioned compensating current mirror circuits, for example. According to the current mirror principle, the compensating voltage $V_C$ is equal to $(V_{DD}-I_F\times R3)$. Therefore, when the feedback currents $I_{FR}$, $I_{FG}$ and $I_{FB}$ attenuate with time, the compensating voltages $V_{CR}$, $V_{CG}$ and $V_{CB}$ are increased with time. Finally, the data currents $I_R$, $I_G$ and $I_B$ are regulated using the compensating voltages $V_{CR}$, $V_{CG}$ and $V_{CB}$ as the reference voltages $V_R$, $V_G$ and $V_B$ for R_DAC 214, G_DAC 216 and B_DAC 218. When the compensating voltages $V_R$, $V_G$ and $V_B$ are increased with time, the data currents $I_R$, $I_G$ and $I_B$ are also increased with time in order to compensate for the luminance attenuations of the R_Pixel 222, G_Pixel 224 and B_Pixel 226.

According to the preferred embodiment, the advantage of the display luminance compensating device of the invention is to utilize the simple feedback circuit design to output the feedback current and to simulate the condition that the current of the real pixel attenuates with time. In addition, the compensating circuit outputs the compensating voltage, which is increased as the feedback current is decreased, as the reference voltage for the digital/analog current converter in order to effectively compensate for the luminance attenuation caused by the pixel current attenuation. Performing the luminance compensations on the red, green and blue pixels simultaneously can keep the same luminance performance after a period of time with respect to the same picture frame, and thus lengthen the lifetime of the OLED display.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method of compensating for luminance of an organic light emitting diode display, which has a pixel matrix including a first pixel of a first color and a second pixel of a second color, the method comprising the steps of:

generating feedback currents including a first feedback current for compensating for luminance of the first pixel of the first color and a second feedback current for compensating for luminance of the second pixel of the second color, the feedback currents generating step comprising:

generating a first operational current of a first dummy light emitting component of the first color and generating a second operational current of a second dummy light emitting component of the second color, wherein the first operational current and the second operational current respectively simulate luminance attenuation of the first pixel of the first color and the second pixel of the second color with time; and substantially duplicating the first operational current and the second operational current as the first feedback current and second feedback current respectively;

generating a first compensating voltage according to the first feedback current and generating a second compensating voltage according to the second feedback current;

compensating for luminance of the first and second pixels by at least adjusting a first data current applied to a first data line for driving the first pixel and a second data current applied to a second data line for driving the second pixel according to the first compensating voltage and the second compensating voltage respectively.

2. The method according to claim 1, wherein the first dummy light emitting component comprises a dummy organic light emitting diode of the first color and the second dummy light emitting component comprises a dummy organic light emitting diode of the second color.

3. The method according to claim 1, wherein the first dummy light emitting component comprises a plurality of dummy organic light emitting diodes of the first color, coupled in parallel; and the second dummy light emitting component comprises a plurality of dummy organic light emitting diodes of the second color, coupled in parallel.

4. The method according to claim 1, wherein the first feedback current and the second feedback current change positively proportional to the luminance change of the first pixel and the second pixel.

5. The method according to claim 1, wherein the changes of the first data current and the second data current are inversely proportional to the changes of first compensating voltage and the second compensating voltage, respectively.

6. The method according to claim 1, wherein the pixel matrix further includes a third pixel of a third color, the feedback currents further include a third feedback current for compensating for luminance of the third pixel of the third color, and the feedback currents generating step further comprises:

generating a third operational current of a third dummy light emitting component of the third color, wherein the third operational current simulates luminance attenuation of the third pixel of the third color with time; and substantially duplicating the third operational current as the third feedback current.

7. The method according to claim 6, further comprising:

generating a third compensating voltage according to the third feedback current;

compensating for luminance of the third pixel by at least adjusting a third data current applied to a third data line for driving the third pixel according to the third compensating voltage.

8. The method according to claim 1, wherein in the step of generating feedback currents, the first operational current and the second operational current are substantially duplicated by using current mirrors to provide the first feedback current and second feedback current respectively.

9. The method according to claim 8, wherein in the step of generating feedback currents, the first operational current and the second operational current are substantially duplicated by using current mirrors coupled to the first and second dummy light emitting components to provide the first feedback current and second feedback current respectively.

10. A method of compensating for luminance of an organic light emitting diode display, comprising:

receiving first digital data and a first reference voltage by a first digital/analog current converter so as to provide a first data current to a first data line of a first pixel of a first color to emit light and receiving second digital data and a second reference voltage by a second digital/analog current converter so as to provide a second data current to a second data line of a second pixel of a second color to emit light;

providing a first feedback current and a second feedback current, comprising:

generating a first operational current of a first dummy light emitting component of the first color and a second operational current of a second dummy light emitting component of the second color; and substantially duplicating the first operational current and the second operational current as the first feedback current and second feedback current respectively;

providing a first compensating voltage as the first reference voltage for the first digital/analog current converter according to the first feedback current; and providing a second compensating voltage as the second reference voltage for the second digital/analog current converter according to the second feedback current;

wherein while the luminance of the first pixel and the second pixel attenuates with time, the first feedback current and the second feedback current reduce with time, such that the first compensating voltage and the second compensating voltage increase with time so as to increase the first data current and the second data current applied to the first data line and the second data line respectively.

11. The method according to claim 10, wherein the first dummy light emitting component comprises a dummy organic light emitting diode of the first color and the second dummy light emitting component comprises a dummy organic light emitting diode of the second color.

12. The method according to claim 10, wherein the first dummy light emitting component comprises a plurality of dummy organic light emitting diodes of the first color, coupled in parallel; and the second dummy light emitting component comprises a plurality of dummy organic light emitting diodes, coupled in parallel.

13. The method according to claim 12, wherein the first feedback current simulates an average current attenuation degree of the dummy organic light emitting diodes of the first color and the second feedback current simulates an average current attenuation degree of the dummy organic light emitting diodes of the second color.

14. The method according to claim 10, wherein in the step of providing a first feedback current and a second feedback current, the first operational current and the second operational current are substantially duplicated by using current mirrors to provide the first feedback current and second feedback current respectively.

15. The method according to claim 14, wherein in the step of providing a first feedback current and a second feedback current, the first operational current and the second operational current are substantially duplicated by using current mirrors coupled to the first and second dummy light emitting components to provide the first feedback current and second feedback current respectively.

* * * * *